US007117897B2

(12) United States Patent
Debaes

(10) Patent No.: US 7,117,897 B2
(45) Date of Patent: Oct. 10, 2006

(54) METHOD AND FACE-TO-FACE WEAVING MACHINE FOR FACE-TO-FACE WEAVING OF AN UPPER AND LOWER FABRIC

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 376 days.

(21) Appl. No.: 10/805,491

(22) Filed: Mar. 22, 2004

(65) Prior Publication Data

US 2004/0221910 A1 Nov. 11, 2004

(30) Foreign Application Priority Data

Mar. 20, 2003 (BE) ..... 2003/0177

(51) Int. Cl.
*D30D 39/16* (2006.01)

(52) U.S. Cl. ..... 139/21; 139/39; 139/40; 139/41; 139/42; 139/44; 139/46; 139/47

(58) Field of Classification Search ..... 139/21, 139/39, 40, 41, 42, 44, 47, 46
See application file for complete search history.

(56) References Cited

U.S. PATENT DOCUMENTS 2,060,502 A * 11/1936 Kaufman
2,108,046 A * 2/1938 Drobile
2,225,452 A * 12/1940 Jacobsen ..... 139/21
2,414,064 A * 1/1947 Schulz et al. ..... 139/47
2,750,964 A * 6/1956 Hoeselbarth ..... 139/39
2,758,613 A * 8/1956 Schmitz ..... 139/39
2,884,012 A * 4/1959 Hoeselbarth ..... 139/39
2,896,671 A * 7/1959 Park et al. ..... 139/46
3,289,706 A * 12/1966 Valentine
3,409,051 A * 11/1968 Carrigan ..... 139/46
6,817,383 B1 * 11/2004 Debaes et al. ..... 139/21
6,837,274 B1 * 1/2005 Debaes et al. ..... 139/21
6,945,280 B1 * 9/2005 Debaes ..... 139/21

FOREIGN PATENT DOCUMENTS

EP 0 974 690 A * 1/2000
EP 1 072 705 A * 1/2001

* cited by examiner

*Primary Examiner*—John J. Calvert
*Assistant Examiner*—Robert H Muromoto
(74) *Attorney, Agent, or Firm*—James Creighton Wray

(57) ABSTRACT

A method and apparatus for face-to-face weaving of an upper and a lower fabric on a face-to-face weaving machine, upper and lower fabric (101, 102) comprising at least a first zone with pile loops, the pile loops being formed around one or several lost pile loop weft yarns (16, 16'), and comprising at least a second zone where no pile loops are formed around lost pile loop weft yarns and catch means (1, 1') being provided for supporting the lost pile loop weft yarns (16, 16') within the second zone in one or several areas in the weft direction where no pile loops are formed around these lost pile loop weft yarns (16, 16').

21 Claims, 3 Drawing Sheets

METHOD AND FACE-TO-FACE WEAVING MACHINE FOR FACE-TO-FACE WEAVING OF AN UPPER AND LOWER FABRIC

This application claims the benefit of Belgian Application No. 2003/0177 filed Mar. 20, 2003.

BACKGROUND OF THE INVENTION

The invention relates to a method and a face-to-face weaving machine for face-to-face weaving of an upper and a lower fabric, said upper and lower fabric comprising at least a first zone with pile loops, the pile loops being formed around lost pile loop weft yarns, and comprising at least a second zone where no pile loops are formed around lost pile loop weft yarns.

In face-to-face weaving with a face-to-face weaving machine an upper and a lower fabric are simultaneously woven. For weaving fabrics with a loop pile, lost pile loop weft yarns are used to realize the pile loops. Most of the time, the lost pile loop weft yarns are inserted above a spacer which is defining the height of the loop. The lost pile loop weft yarns are removed from the upper and the lower fabric, after having separated the upper and the lower backing fabric, and when the loop pile is combined with the cut pile after cutting through the zones with the pile to be cut (the pile which extends between the lower and the upper fabric).

In face-to-face weaving of an upper and a lower fabric on a face-to-face weaving machine, in which said upper and/or lower fabric comprises at least a first zone with pile loops, where the pile loops are formed around lost pile loop weft yarns, and comprises at least a second zone where no pile loops are formed around lost pile loop weft yarns, the problem claims the attention that when in said second zone in the upper and/or the lower fabric, an area in the weft direction where no pile loops are formed around lost pile loop weft yarns will bridge a considerable length, this lost weft yarn will not be kept by pile loops over this length. This may have several disadvantageous consequences during the weaving process. As far as the upper fabric is concerned, this means that the lost pile loop weft yarns may sag. First of all, this sagging may result in that the lost pile loop weft yarns may get in touch with the lower fabric and may get stuck there. Furthermore, the lost pile loop weft yarns may end up in the reach of the cutting device, because of which they might impede the separation of the upper from the lower fabric. When the loop pile is combined with the cut pile, the cutting process of the pile to be cut may be impeded. Furthermore, excessive wear of the knife may occur, the lost pile loop weft yarns may become stuck between the knife carriage and the guide, the pile loop weft yarn itself may be cut through, because of which it will be impossible to remove it entirely after the upper and the lower fabric have been separated. As far as the lower fabric is concerned, this means that with a combination of loop pile and cut pile in said second zone, where one or several areas occur in the weft direction, where no pile loops are formed around lost pile loop weft yarns, these areas will influence the cutting process of the pile to be cut in the same negative way.

In BE 9900493 a fabric with a combination of cut pile and false boucle is described (forming of loop pile around a weft yarn which is situated on the backing fabric and most of the time is a thick weft yarn). In said patent may be seen that, between 2 pile tufts of the cut pile, false pile loops are formed over the thick weft yarn, in order to avoid that this weft yarn will sag or will hang freely when no pile loops are formed in the weft direction around the various warp yarn systems of a wider zone. The disadvantage of this principle is, that it can only be applied with false loops, as they will lean closely against the backing fabric and will be present unnoticed between the cut pile. However, with a true forming of loops, because of its height and because of its tendency to bend also in the warp direction, the pile loop will not be able to secure the lost weft yarns unnoticed in the same manner.

SUMMARY OF THE INVENTION

Therefore, the purpose of the invention is to provide a method and a face-to-face weaving machine for face-to-face weaving of an upper and a lower fabric, as described in the first and second paragraph of the text of this description, where one or several areas in the weft direction where no pile loops are formed around lost pile loop yarns in the said one or several second zones, have no harmful effect on the weaving and cutting processes of the upper and the lower fabric.

According the present invention, this purpose is attained by providing a method having the characteristics indicated in the first paragraph of this description and catch means being provided for supporting the lost pile loop weft yarns within said second zone in one or several areas in the weft direction where no pile loops are formed around these lost pile loop weft yarns.

In this manner, in said second zone where one or several areas in the weft direction are found where no pile loops are formed around lost pile loop weft yarns, this one or these several areas in the weft direction of the lost pile loop weft yarns will no longer be able to disturb the weaving and cutting processes of the upper and the lower fabric.

In a preferred method according to the invention, said face-to-face weaving machine is provided with a weaving reed, and said catch means for the upper and/or lower fabric are provided in the spaces between the reed dents at regular intervals.

In a more preferred method according to the invention said catch means for the upper and the lower fabric are provided in different spaces between reed dents.

This has the advantage that by distributing the catch means for the upper and the lower fabric in different spaces between the reed dents, these spaces are less filled and because of this, they are distributed more evenly across the width of the face-to-face weaving machine.

Preferably, in this method according to the invention, the lost pile loop weft yarns are inserted by means of weft insertion means, and the catch means for the upper and the lower fabric are moved between minimum two positions, in a first position, the pile loop weft yarns for the upper fabric being inserted, the catch means for the upper and/or the lower fabric being situated under said weft insertion means, and in a second position, the lost pile loop weft yarns for the lower backing fabric being inserted, the catch means for the lower and/or the upper backing fabric being situated under the weft insertion means.

In doing so, the catch means may be moved between the minimum two positions in different manners:

- a first manner is by suspending and distributing them over one or several weaving frames;
- a second manner is by coupling them to one or several knives of a selection device moving up and down;
- a third manner is by coupling them to a mechanical or electromechanical device realizing the minimum two positions.

The catch means may be carried out in various ways.

In a first preferred method according to the invention, the catch means are fixedly attached in two connecting points of the face-to-face weaving machine, a first connecting point being situated after the cutting blade of the cutting device, and a second connecting point being situated before the weft insertion zone. By the indication after and before, here the direction the fabric follows during the weaving process is considered. "After" means here further on the way the yarns and the upper and the lower fabric are following. "Before" means earlier on the way the yarns and the upper and the lower fabric are following.

Preferably, said first point is situated after the zone where the lost pile loop yarns are removed from the upper and the lower fabric.

More preferably, said first point is situated on the cutting rail on which the cutting blade is moving back and forth.

On the one hand, said second point may be a fixed point of the face-to-face weaving machine.

On the other hand, said second point may be an element ensuring the motion of the shedding of the catch means.

In a preferred method according to the invention an elastic element has been provided between said first and second points.

In such a manner the motion for the shedding can be made possible at an almost constant tension of the catch means.

Preferably, said elastic element is provided at one of the extremities of the catch means.

More preferably, said elastic element is provided at the extremity of the catch means which are situated before the weft insertion zone of the face-to-face weaving machine.

In a second preferred method according to the invention, the catch means are supplied continuously and are moving almost evenly along with the warp yarns of the upper and the lower fabric.

Preferably, said catch means being supplied from one or several bobbins.

After having separated the upper fabric from the lower fabric, the catch means are preferably conducted to one or both sides of the face-to-face weaving machine.

According to this method, the catch means preferably consist of one or several catch warp yarns, each being conducted by means of a guide eye and being removed from the fabric zone by means of a driving drum.

In a preferred method according to the invention, said one or several areas in the weft direction, where no pile loops are formed around lost pile loop weft yarns, have a length of at least 5 cm.

In a preferred method according to the invention, the catch means consist of catch warp yarns in the form of strings, yarns, warp yarns, metal wires and/or tapes.

According to this invention, the purpose is attained by providing a face-to-face weaving machine having the characteristics mentioned in the first paragraph of this description, and the face-to-face weaving machine being provided for carrying out a method as described above.

The characteristics and particulars of the present invention are further explained hereafter by means of two embodiments by way of an example, referring to the attached drawings. It should be noted that specific aspects are only described by way of a preferred example of what is meant in the scope of the above-mentioned general description of the invention, and by no means may be interpreted as a restriction of the scope of the present invention as such and as expressed in the following claims.

In the attached drawings:

DETAILED DESCRIPTION OF THE PREFERRED EMBODIMENTS

Figure 1:
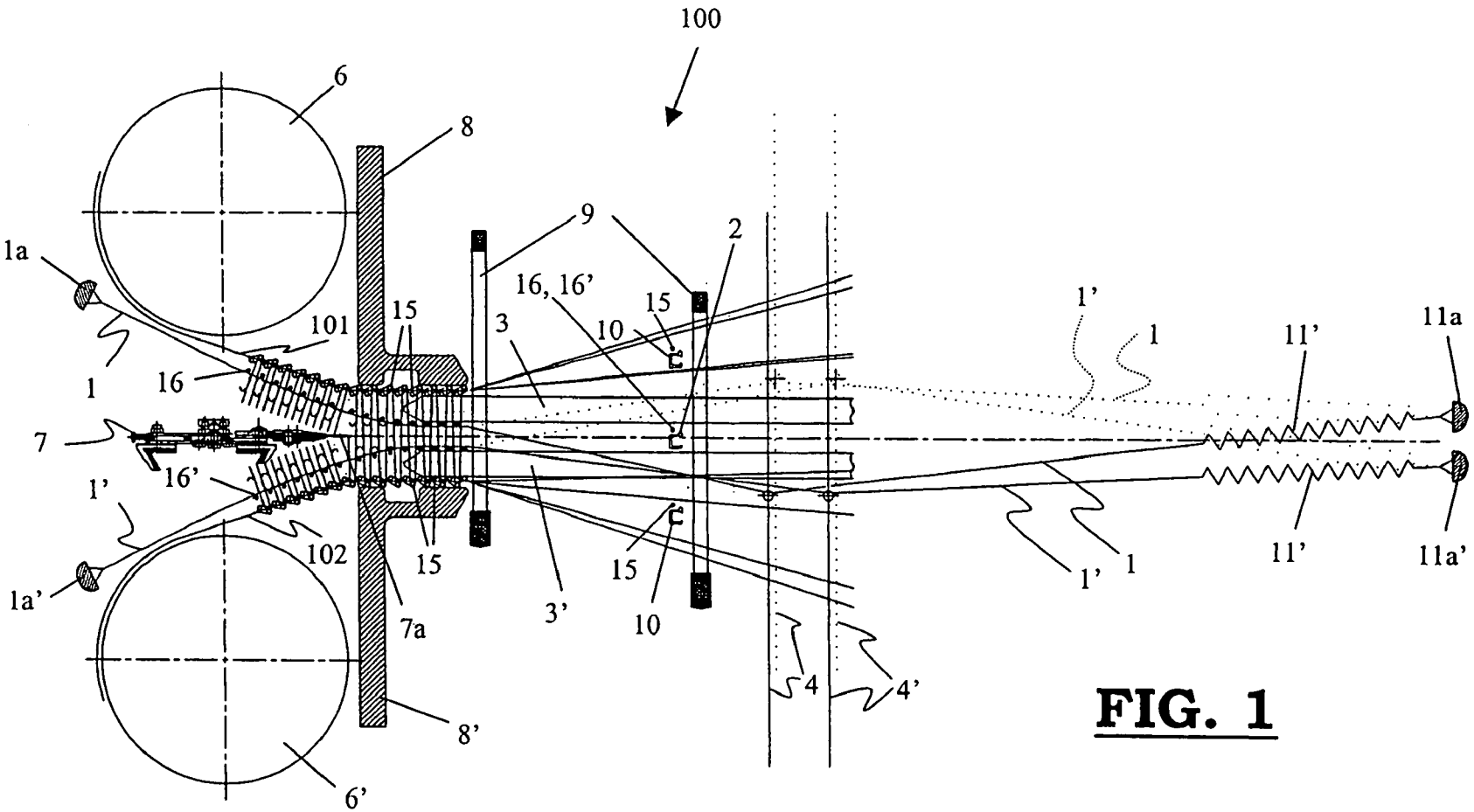
FIG. 1 is a schematic representation of a face-to-face weaving machine for applying a first embodiment of a method for face-to-face weaving of one upper and one lower fabric, said upper and/or lower fabric comprising at least a first zone with pile loops, the pile loops being formed around lost pile loop weft yarns and comprising at least a second zone with one or several areas in the weft direction where no pile loops are formed around lost pile loop weft yarns.
Figure 2:
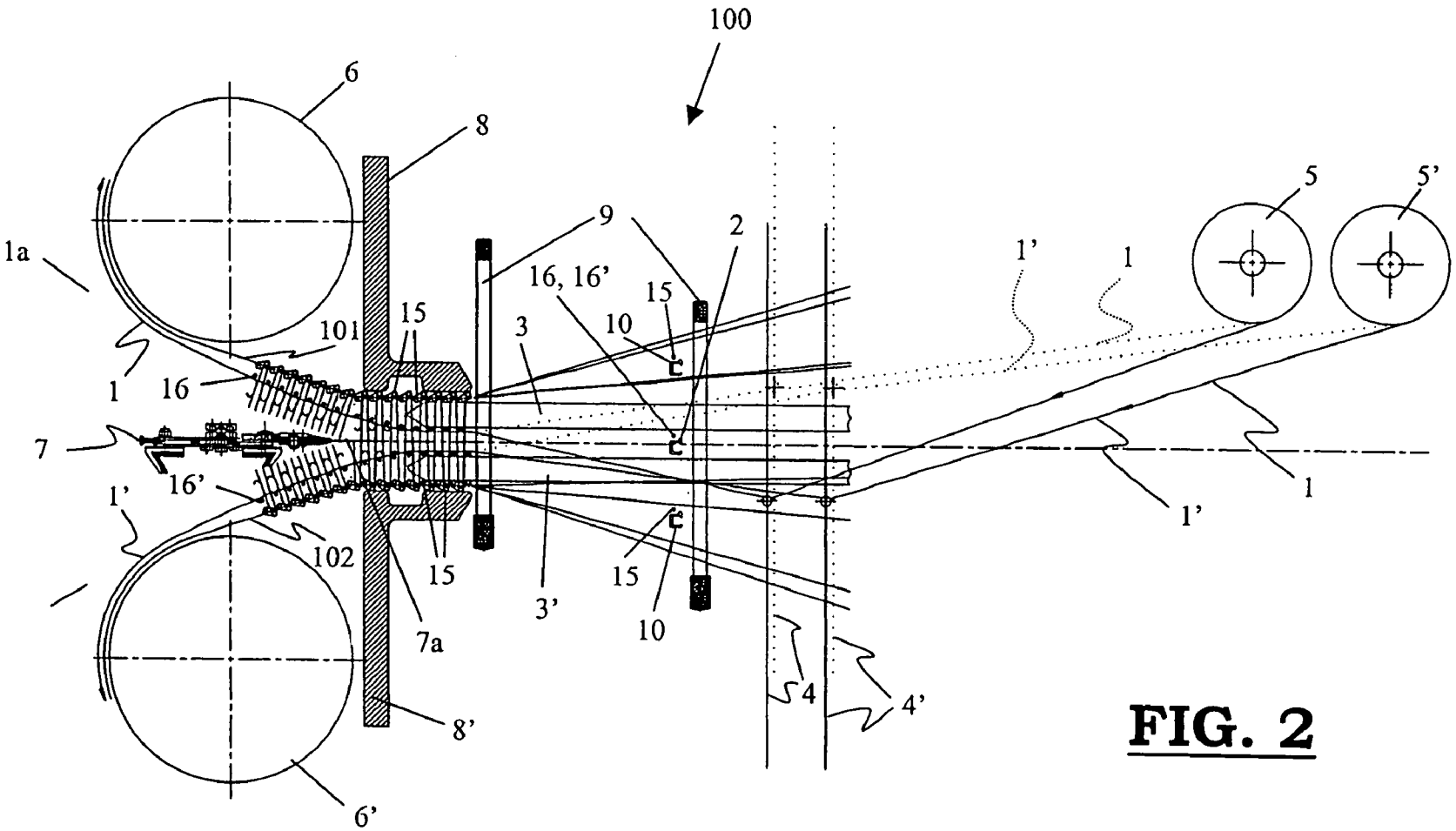
FIG. 2 is a schematic representation of a face-to-face weaving machine for applying a second embodiment of a method for face-to-face weaving of one upper and one lower fabric, said upper and/or lower fabric comprising at least a first zone with pile loops, the pile loops being formed around lost pile loop weft yarns and comprising at least a second zone with one or several areas in the weft direction where no pile loops are formed around lost pile loop weft yarns.

In a method according to the invention, use is made of a face-to-face weaving machine (100) as shown in the FIGS. 1 and 2 for face-to-face weaving of an upper and a lower fabric (101, 102) said upper and/or lower fabric (101, 102) comprising at least a first zone with pile loops, the pile loops being formed around lost pile loop weft yarns (16, 16'), and at least comprising a second zone with one or several areas in the weft direction where no pile loops are formed around lost pile loop weft yarns (16, 16'). The upper and the lower fabric (101, 102) are separated by means of a cutting device (7) which is provided with a cutting blade (7*a*).

The face-to-face weaving machine (100) comprises a weft insertion mechanism consisting of three weft insertion devices, i.e. an upper (10) and a lower weft insertion device (10') for inserting the weft yarns (15, 15') of the upper and the lower fabric and a central weft insertion device (2) for inserting the lost pile loop weft yarns (16, 16'), i.e. the lost pile loop weft yarns (16) for the upper fabric (101) and the lost pile loop weft yarns (16') for the lower fabric (102) in order to form the pile loops. The lost pile loop weft yarns (16, 16') are here inserted above spacers (3, 3') which are defining the height of the pile loops.

In said one or several second zones of the upper and/or the lower fabric (101, 102) comprising one or several areas in the weft direction with lost pile loop weft yarns (16, 16') around which no pile loops are formed, especially for areas having a length in the weft direction from 5 cm upwards, these lost pile loop weft yarns (16, 16') have an inconvenient effect. These lost pile loop weft yarns (16) of the upper fabric (101) have a tendency to sag in one or several areas where no pile loops are formed around these lost pile loop weft yarns (16), because of which the following harmful effects may occur:

- the lost pile loop weft yarns (16) may get in touch with the lower fabric (102) and may get stuck there;
- the lost pile loop weft yarns may come within reach of the cutting device, because of which they will interfere with the separation of the upper and the lower fabric (101, 102);

in case the loop pile will be combined with a cut pile, the cutting process of the pile to be cut may be obstructed;

excessive wear of the blade may occur;

the lost pile loop weft yarns (16) may get stuck between the knife carriage and the guide;

the pile loop weft yarns (16) themselves may be cut through, because of which it will become impossible to remove them completely after having separated the upper from the lower fabric (101, 102).

As far as the lower fabric (102) is concerned, this means that with a combination of loop pile and cut pile, such lost pile loop weft yarns (16') with one or several areas around which no pile loops are formed, the cutting process will influence the cutting process in a negative manner in the same way.

In order to solve this problem, catch means are provided to support the lost pile loop weft yarns (16, 16') within said second zone in one or several areas in the weft direction where no pile loops are formed around these lost pile loop weft yarns (16, 16'). Preferably these catch means consist of catch warp yarns (1) in the form of strings, yarns, warp yarns, metal wires and/or tapes.

Catch warp yarns (1) may be provided for the upper fabric (101), for the lower fabric (102) or for both fabrics. In the FIGS. 1 and 2 catch warp yarns (1), (1') respectively are provided both for the upper fabric (101) and for the lower fabric (102). The catch warp yarns (1, 1') are added in the spaces between the reed dents of the weaving reed (9) of the face-to-face weaving machine. Preferably, this is done at regular intervals, for instance at each 5, 8, 10, 12, 20 or 25 cm. The catch warp yarns (1, 1') for the upper and the lower fabric (101, 102) may be situated in different spaces between the reed dents which leads to a more regularly distributed filling of the spaces between the reed dents. Because of which, each time only one catch warp yarn (1, 1'), and not two, is added in the spaces between the reed dents in which the catch warp yarns have been provided, as it is the case when the catch warp yarns (1, 1') for the upper and the lower fabric (101, 102) are provided in the same space between the reed dents.

During shedding, the catch warp yarns (1, 1') should take up a position in order to catch the lost pile loop weft yarns (16, 16'). When the pile loop weft yarn (16) for the upper fabric (101) has to be inserted, the catch warp yarns (1) for the upper fabric have to be in a position under the central weft insertion device (2) in the shedding and the lost pile loop weft for the lower fabric (102) is situated in the same position, i.e. under the central weft insertion device (2).

When the pile loop weft yarn (16') for the lower fabric (102) has to be inserted, the catch warp yarns (1') for the lower fabric (102) have to be in a position above the central weft insertion device (2), and the catch warp yarns (1) for the upper fabric (101) are also situated in this position, i.e. above the central weft insertion device (2).

The motion of the catch warp yarns (1, 1') between these minimum two positions may be realized by suspending and distributing the catch warp yarns (1, 1') for the upper and the lower fabric (101, 102) over one or several weaving frames (not represented in the figures). When per two picks of the face-to-face weaving machine there should be a repeat of the insertion of pile loop weft yarns (16, 16'), i.e. in a first pick the catch warp yarns (1, 1') for the upper and the lower fabric (101, 102) are in a first position, and in a second pick the catch warp yarns (1, 1') are in a second position, and this is repeated during the weaving process, than the catch warp yarns (1) may be coupled to the knives of a selection device moving up and down, for instance the Jacquard mechanism of the face-to-face weaving machine. Furthermore, this motion between the minimum two positions may also be realized by coupling the catch warp yarns (1, 1') to a lifting device (4, 4') which will be able to realize the minimum two positions of the pile loop weft yarns (16, 16') and the repeat per two picks of the face-to-face weaving machine in a mechanical or electromechanical manner.

The catch warp yarns (1, 1') may be carried out in various ways.

As represented in FIG. 1, the catch warp yarns (1, 1') may be connected fixedly in two connecting points of the face-to-face weaving machine (100). A first connecting point being situated after the cutting blade (7*a*) of the cutting device (7), while a second connecting point is situated before the weft insertion zone. By the indication after and before, the direction followed by the upper and the lower fabric (101, 102) during the weaving process being considered. "After" means further on along the way, the yarns and the upper and the lower fabric (101, 102) are following, while "before" means earlier on the way the yarns and the upper and the lower fabric (101, 102) are following.

Preferably, said first connecting point is situated after the zone where the lost pile loop weft yarns (16, 16') are removed from the upper and the lower fabric (101, 102). In FIG. 1, the catch warp yarns (1) for the upper fabric (101) are connected in an upper first fixed connecting point (1*a*) of the face-to-face weaving machine, and the catch warp yarns (1') for the lower fabric (102) are connected to a lower first fixed connecting point (1*a'*) of the face-to-face weaving machine. Said first connecting point may be situated, for instance, on the cutting bench on which the cutting rail (7*a*) is moving back and forth.

At the other extremity, the catch warp yarns (1, 1') are fixedly connected to said second connecting point, which, preferably, is a fixed point of the face-to-face weaving machine, for instance, a cross beam. However, the second connecting point may also be an element for the motion of the shedding of the catch warp yarns (1, 1'). In FIG. 1, the catch warp yarns (1) for the upper fabric (101) are connected in an upper second fixed connecting point (11) of the face-to-face weaving machine and the catch warp yarns (1') for the lower fabric (102) are connected in a lower second fixed connecting point (11') of the face-to-face weaving machine.

In order to enable the motion of the shedding at an almost constant tension of the catch warp yarns (1, 1'), springs (11, 11') are preferably inserted between the first (11*a*, 11*a'*) and the second connecting point (1*a*, 1*a'*). In FIG. 1, a first spring (11) is represented for the catch warp yarns (1) of the upper fabric (101), while a second spring (11') is represented for the catch warp yarns (1') for the lower fabric (102). Preferably, these springs (11, 11') are provided at one of the extremities of the catch warp yarns (1, 1') and still more preferably, at the extremity of the catch warp yarns (1, 1') which is situated before the weft insertion zone of the face-to-face weaving machine.

As in this first embodiment, the catch warp yarns (1, 1') are subjected to wear, because of the continuous effect of the lost pile loop weft yarns (16, 16') sliding on them, this might have the disadvantage that the catch warp yarns (1, 1'), practically not moving in the warp direction, might make the lost pile loop weft yarns (16, 16') to accumulate and might cause the upper and/or the lower fabric to get jammed and caught between the catch warp yarns (1, 1') and the upper or lower ruler (8, 8') of the face-to-face weaving machine. Excessive tension or rupture of the catch warp yarns (1, 1') may be monitored by means of drop blades which will give a signal to the face-to-face weaving machine in case a catch warp yarn (1, 1') breaks or is subjected to an excessive tension, so that the face-to-face weaving machine may be stopped.

Figure 3:
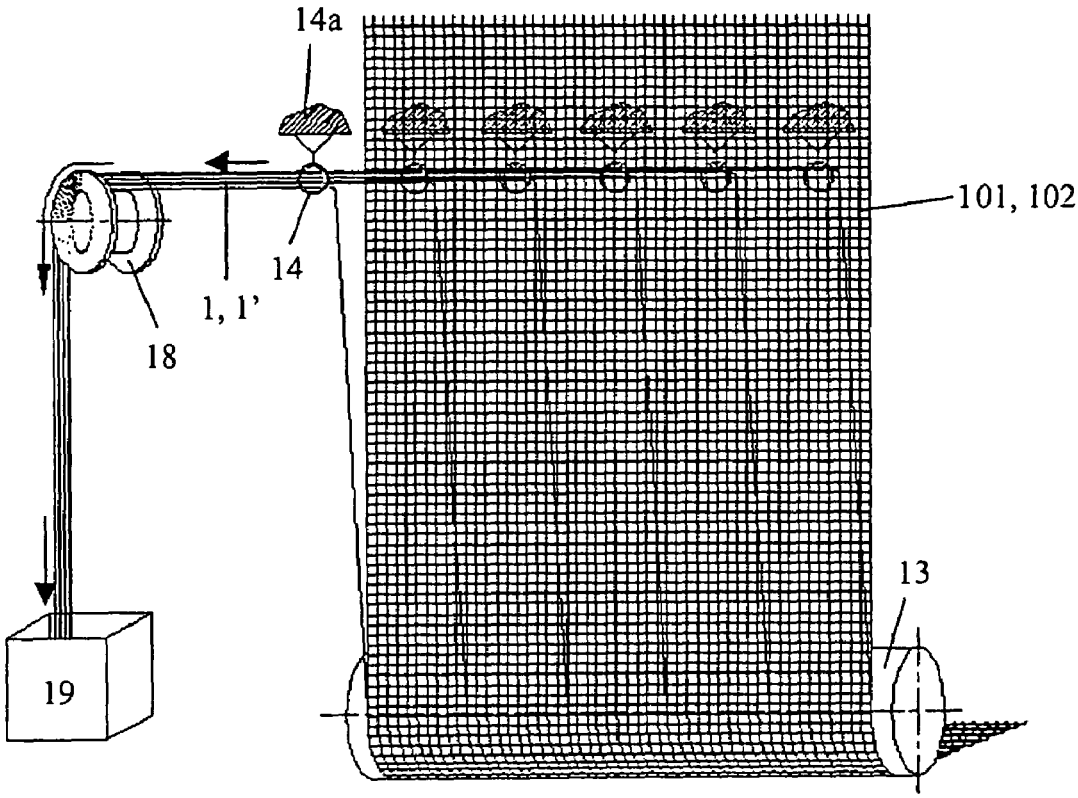
FIG. 3 is a front view of a device as represented in FIG. 2, the catch means being lead away on one side of the face-to-face weaving machine.

To avoid any malfunctioning as a consequence of this process of wear, a second preferred embodiment of the invention is represented in FIGS. 2 and 3, the catch warp yarns (1, 1') being continuously supplied and moving almost evenly with the warp yarns of the upper and the lower fabric (101, 102). In this embodiment, the catch warp yarns (1, 1') may be supplied from one or several bobbins (5, 5'), coming from the pile yarn weaving creel, for instance. In FIG. 2 the catch warp yarns (1) for the upper fabric (101) are supplied from a first bobbin (5), while the catch warp yarns (1') for the lower fabric (102) are supplied from a second bobbin (5'). After having separated the upper and the lower fabric (101, 102), the catch warp yarns (1, 1') extending and moving in the warp direction are conducted to one or both sides of the face-to-face weaving machine, as represented in FIG. 3. For this purpose, a reversing roller (13) is provided enabling a change of direction, for instance, an upward deflection, to be performed during removal of the upper and the lower fabric (101, 102) from the face-to-face weaving machine towards the lay down device for these fabrics (101, 102) or the winding device for the upper and the lower fabric (101, 102). The upper fabric (101) and the lower fabric (102) being removed under tension by means of a draw roller (6, 6' respectively). As represented in FIG. 3, each catch warp yarn (1, 1') is conducted, for instance, through a guide eye (14), which is attached in a connecting point (14*a*), for instance, a cross beam of the face-to-face weaving machine, and is removed from the fabric zone by means of a driving drum (18). The catch warp yarns (1, 1') are collected in a container (19).

The invention claimed is:

1. Method for face-to-face weaving of an upper and a lower fabric on a face-to-face weaving machine, said upper and/or lower fabric comprising at least a first zone with pile loops, the pile loops being formed around one or several lost pile loop weft yarns, and comprising at least a second zone where no pile loops are formed around lost pile loop weft yarns, wherein catch means are provided to support the lost pile loop weft yarns within said second zone in one or several areas in the weft direction where no pile loops are formed around these pile loop weft yarns; the catch means consisting of catch warp yarns in the form of strings, yarns, warp yarns, and/or metal strings.

2. Method according to claim 1, wherein said face-to-face weaving machine is provided with a weaving reed and said catch means for the upper and/or the lower fabric being provided at regular intervals in the spaces between the reed dents.

3. Method according to claim 2, wherein said catch means for the upper and the lower fabric are provided in several spaces between the reed dents.

4. Method according to claim 1, wherein the lost pile loop weft yarns are inserted with the help of weft insertion means, and the catch means for the upper and the lower fabric being moved between minimum two positions, in a first position, in which the lost pile loop weft yarns for the upper fabric are inserted, the catch means for the upper and/or the lower fabric being situated below the weft insertion means and in a second position, in which the lost pile loop weft yarns for the lower fabric are inserted, the catch means for the lower and/or the upper fabric being situated above the weft insertion means.

5. Method according to claim 4, wherein the catch means are moved between the minimum two positions by suspending them and distributing them over one or several weaving frames.

6. Method according to claim 4, wherein the catch means are moved between the minimum two positions by coupling them to one or several knives of a selection device moving up and down.

7. Method according to claim 4, wherein the catch means are moved between the minimum two positions by coupling them to a mechanical or electromechanical device which realizes the minimum two positions.

8. Method according to claim 1, wherein the catch means are fixedly attached in two connecting points of the face-to-face weaving machine, a first connecting point being situated after the cutting blade of the cutting device, and a second connecting point being situated before the weft insertion zone.

9. Method according to claim 8, wherein said first connecting point is situated after the zone where the lost pile loop weft yarns are removed from the upper and the lower fabric.

10. Method according to claim 8, wherein said first connecting point is situated on the cutting rail on which the cutting blade is moving back and forth.

11. Method according to claim 8, wherein said second connecting point is a fixed point of the face-to-face weaving machine.

12. Method according to claim 8, wherein said second connecting point is an element which ensures the motion of the shedding of the catch means.

13. Method according to claim 8, wherein said first connecting point and second connecting point have been provided with an elastic element.

14. Method according to claim 13, wherein said elastic element is provided at one of the extremities of the catch means.

15. Method according to claim 14, wherein said elastic element is provided at the extremity of the catch means which is situated before the weft insertion zone of the face-to-face weaving machine.

16. Method according to claim 1, wherein the catch means are supplied in a continuous manner and are moving almost evenly with the warp yarns of the upper and/or the lower fabric.

17. Method according to claim 16, wherein said catch means are supplied from one or several bobbins.

18. Method according to claim 16, wherein after the upper and the lower fabric having been separated, the catch means are conducted to one or both sides of the face-to-face weaving machine.

19. Method according to claim 18, wherein the catch means consist of one or several catch warp yarns which each are conducted by means of a guide eye and which are removed from the fabric zone by means of a driving drum.

20. Method according to claim 1, wherein said one or several areas in the weft direction where no pile loops are formed around lost pile loop weft yarns have a length of at least 5 cm.

21. Face-to-face weaving machine for face-to-face weaving of an upper and a lower fabric, said upper and/or lower fabric comprising at least a first zone with pile loops, said pile loops being formed around lost pile loop weft yarns and comprising at least a second zone where no pile loops are formed around lost pile loop weft yarns, wherein the face-to-face weaving comprises catch means for supporting said lost pile loop weft yarns within said second zone in one or several areas in the weft direction where no pile loops are formed around these pile loop weft yarns; the catch means consisting of catch warp yarns in the form of strings, yarns, warp yarns, and/or metal strings; and said catch means for the upper and/or lower fabric being provided at regular intervals in the spaces between reed dents.

* * * * *